US006939098B2

(12) United States Patent
Schults

(10) Patent No.: US 6,939,098 B2
(45) Date of Patent: Sep. 6, 2005

(54) STRADDLE CARRIER

(76) Inventor: Tommy Schults, 11 Tracey St., Kenmore, Queensland, 4069 (AU)

( * ) Notice: Subject to any disclaimer, the term of this patent is extended or adjusted under 35 U.S.C. 154(b) by 184 days.

(21) Appl. No.: 10/252,526

(22) Filed: Sep. 24, 2002

(65) Prior Publication Data

US 2004/0013504 A1 Jan. 22, 2004

Related U.S. Application Data

(63) Continuation-in-part of application No. 09/147,390, filed as application No. PCT/AU97/00323 on May 23, 1997, now abandoned.

(51) Int. Cl.[7] ..... B65J 1/10
(52) U.S. Cl. ..... 414/459
(58) Field of Search ..... 414/745.6, 458, 414/459, 460, 909

(56) References Cited

U.S. PATENT DOCUMENTS

| | | | | |
|---|---|---|---|---|
| 1,289,529 A | | 12/1918 | Overlin | |
| 2,512,333 A | | 6/1950 | Jaffa et al. | |
| 2,576,345 A | | 11/1951 | Jacob | |
| 3,019,926 A | | 2/1962 | Christenson | |
| 3,156,484 A | | 11/1964 | Talbert | |
| 3,327,996 A | | 6/1967 | Morse | |
| 3,405,781 A | * | 10/1968 | Brown | 187/219 |
| 3,497,231 A | | 2/1970 | Fulmer et al. | |
| 3,541,598 A | | 11/1970 | Dousset | |
| 4,020,952 A | * | 5/1977 | Scodino | 414/745.6 |
| 4,171,927 A | | 10/1979 | Aoyama | |
| 4,546,891 A | | 10/1985 | Lanigan, Sr. et al. | |
| 4,551,059 A | * | 11/1985 | Petoia | 414/459 |
| 4,683,969 A | | 8/1987 | Littau | |
| 4,746,260 A | | 5/1988 | Norvell | |
| 5,114,295 A | * | 5/1992 | Jansson | 414/460 |
| 5,800,114 A | * | 9/1998 | Secondi | 414/458 |
| 5,803,280 A | | 9/1998 | Mende et al. | |

FOREIGN PATENT DOCUMENTS

| | | |
|---|---|---|
| DE | 23 36 710 | 2/1975 |
| DE | 2437208 | 2/1976 |
| DE | 4126728 | 1/1996 |
| DE | 19539914 | 5/1996 |
| DE | 4440180 | 5/1998 |
| EP | 0362988 | 7/1959 |
| FR | 2018423 | 5/1970 |
| FR | 2067895 | 8/1971 |
| FR | 2244699 | 4/1975 |
| GB | 2084110 | 4/1982 |
| NL | 8802239 | 8/1988 |
| SU | 1527035 | 10/1987 |
| WO | WO9429210 | 5/1994 |

* cited by examiner

*Primary Examiner*—Eileen D. Lillis
*Assistant Examiner*—Charles A. Fox
(74) *Attorney, Agent, or Firm*—Hoffman, Wasson & Gitler, P.C.

(57) ABSTRACT

The straddle carrier comprising separate front and rear towers, each tower being of a generally inverted U shaped configuration and having a pair of ground wheel assemblies which can be spaced apart sufficiently to allow a container to locate between the assemblies, each tower including attachment means to attach the tower to the container, each tower having lifting means to lift the container. By having separate front and rear towers, as opposed to a chassis arrangement of existing straddle carriers, the straddle carrier according to the invention can be simply attached to each corner of a container of any length. Thus, the straddle carrier can be used on containers having lengths of 20 ft, 40 ft, and 50 ft, and can also handle containers without side walls or front or back walls which are also called flat beds or flat racks.

18 Claims, 13 Drawing Sheets

15A
36
54
41
38
50
53
52
30

15A
36
53
56
54
41
15B
52
15C
54

15A
36
41
40
15B
15C
51
50
30

STRADDLE CARRIER

CROSS REFERENCE TO RELATED APPLICATIONS

This application is a continuation in part of U.S. Ser. No. 09/147,390 filed Dec. 15, 1998, now abandoned, which is a 371 of PCT/AU99/00323, filed May 23, 1997.

FIELD OF THE INVENTION

This invention relates to a straddle carrier and particularly to a straddle carrier for lifting and transporting shipping containers.

BACKGROUND ART

Straddle carriers are known in the art and are used at shipping ports to convey shipping containers and to load shipping containers onto a truck, or unload shipping containers from a truck.

These known straddle carriers have an extremely strong and heavy horizontal chassis on which or in which a shipping container can locate. A pair of inverted U-shaped tower assemblies are fixed to, or are part of the horizontal chassis and straddle the shipping container (hence the name straddle carrier). Ground engaging wheels are fixed to the chassis and an operator's cabin is located underneath the chassis but above the ground and usually between the front and rear wheels.

The existing straddle carriers suffer from a number of disadvantages. Firstly, the straddle carriers carry shipping containers at least 1.5 m above the ground surface. Therefore, together with the tower assembly, the height of the straddle carrier is such that it cannot be easily manoeuvred in and out of storage sheds.

Another disadvantage with existing straddle carriers is that by having the shipping container fairly high above the ground, the centre of gravity of the straddle carrier is also fairly high which requires an extremely strong and heavy chassis.

Yet another problem with existing straddle carriers is that the carriers are not readily adapted to accommodate shipping containers of various lengths. That is, shipping containers are known to have lengths of between 20–50 ft., and it is dangerous for a short length straddle carrier to carry a long shipping container due to the overhang of the container from each end of the straddle carrier.

An attempt has been made to overcome the length disadvantage by making the chassis of the straddle carrier telescopic but this adds to the weight and greatly increases the cost of the straddle carrier.

Another type of known container support device is a Container Load Trailer, or CLT. The CLT comprises two separate wheel bogies which can be attached to the front and rear ends of a container. When attached, the container can be towed by a truck. A first main disadvantage with the CLT system is that the bogies are attached to the front and rear of the containers, and as each bogie is about 3 m long, the two bogies add about 6 m to the length of the container. This makes maneuvering and turning of the container extremely difficult.

The second main disadvantage with the CLT system is that it is extremely difficult to load a container to the back of a truck. Typically, the container is loaded lengthwise on the truck, but as the bogies are attached to the front and the end of the container, the truck must reverse sideways under the container and then by a process of repeated forward and rearward movements, maneuver itself such that the container is approximately lengthwise on the truck. The bogies can then be decoupled, but it is found that often the locking slots on the container do not line up with the locking pins on the truck.

The CLT bogies can also be used for sidelifting a container, which allows a truck to move lengthwise underneath the container, overcoming the above disadvantage, but once the truck has left, the bogies need to be decoupled and re-positioned to the front and the end of the container to allow the container to be towed.

A further disadvantage with existing straddle carriers is that the straddle carriers are too large to be portable. That is, a conventional straddle carrier does not fit inside a shipping container. In poorer countries, aid or other goods are shipped in containers for security purposes. The poorer countries rarely have the required straddle carriers or other lifting devices to allow the containers to be readily transported away from the port.

The CLT is designed to fit inside a shipping container, but requires a great amount of assembly and attachment to the container to make it useful.

Yet another disadvantage of existing carriers is that the attachment means to attach the carrier to the container are located at the ends of the container. This does not allow the towers to pivot with respect to the container and therefore the wheels cannot maintain contact with the ground when travelling over rough or uneven ground. The problem can be seen in the drawings. FIG. 22 shows an impression of what may occur if prior art inventions were subjected to uneven ground.

As can be seen from this drawing of a prior art invention, the wheels cannot maintain contact with the uneven ground given that the attachment pins must maintain attachment with the container. This results in an increased bending moment and a large increase in torsional forces which can result in stress cracking and weakening in the load bearing elements of the prior art device.

The present invention is directed to a simple, efficient straddle carrier which can lift and transport shipping containers of any length and which has a low height profile making it more suitable for manoeuvring in and out of storage sheds.

OBJECT OF THE INVENTION

It is an object of the invention to provide a straddle carrier which may overcome the abovementioned disadvantages or provide the public with a useful or commercial choice.

In one form, the invention resides in a straddle carrier for lifting and transporting shipping containers, the straddle carrier comprising separate front and rear towers, each tower being of a generally inverted U shaped configuration and having a pair of ground wheel assemblies which can be spaced apart sufficiently to allow a container to locate between the assemblies, each tower including attachment means to attach the tower to the container, each tower having lifting means to lift the container.

By having separate front and rear towers (as opposed to a chassis arrangement of existing straddle carriers), the straddle carrier according to the invention can be simply attached to each corner of a container of any length. Thus, the straddle carrier can be used on containers having lengths of 20 ft, 40 ft, and 50 ft, and can also handle containers without side walls or front or back walls which are also called flat beds or flat racks.

Each tower can, in use, extend adjacent each side and over the top of a container. Thus, each tower may have a pair of side vertical members interconnected by an upper horizontal member. The vertical members and the horizontal member may comprise posts which are typically formed from steel box section.

Each ground wheel assembly may have a number of ground wheels, and the ground wheels are suitably arranged such that the tower is free-standing. Thus, it is preferred that each wheel assembly has front and rear in-line wheels extending forwardly and rearwardly of the vertical member.

The ground wheels may support a generally horizontal base plate or chassis and the vertical member may have a lower end attached to and supported by the base plate or chassis.

Each tower has attachment means to attach the tower to the container. The type of attachment means may depend on the type of container. For instance, if the container has ISO corner castings fitted to each corner of the container, the attachment means may comprise a pin which can insert into the casting.

Each pin may comprise a head with a cam lock to twist lock into the ISO corner castings. Each pin may be rotatable between a locked position where the cam lock engages and locks the pin into the corner casting and an unlocked position where the pin is not locked into the corner casting. While the pin is in the unlocked position, it may still be located in the corner casting but not locked into it. The pin may be maintained in the corner casting by the operation of the side shift mechanism. Each pin may also comprise a twist arm to allow the pin to be moved between the locked and unlocked position.

It is preferred that each tower is attached to the side of the container as opposed to the front or rear ends of the container, thereby allowing the container to be more easily lifted onto or from the back of a truck.

The attachment means may suitably allow the container to pivot with respect to the carrier or more preferably, allow the carrier to pivot with respect to the container. This feature may suitably allow the wheels on each wheel assembly to track the ground in the event of a rough or uneven surface.

The present invention allows the towers to pivot with respect to the container. This may result in the container remaining substantially level even when travelling over rough ground. Due to the wheels being able to maintain contact with the ground, the torsional forces may be reduced and this may lead to a reduction in stress cracking and the concentration of loading forces, and a corresponding increase in the versatility and safety of the carrier of the present invention.

The towers may suitably be able to pivot independently of one another. The towers may be separate, but may be linked to one another by a non-rigid element for example, a chain. This may allow the towers to move independently of one another but not move apart beyond the length of the non-rigid element.

The functionality of the present invention may be provided by the use of attachment pins on each tower being attached to the side of the container as opposed to the front or rear ends of the container, in conjunction with the front and rear towers not being attached to each other rigidly. The carrier may pivot with respect to the container as the container may then remain in a relatively level orientation at all times, particularly when being lifted onto and from the back of a truck or while the container is being moved.

The attachment means may be attached to a sleeve member, the sleeve member being slideable along each vertical member of the tower. A lifting means is provided which can facilitate sliding of the sleeve member thereby functioning to raise or lower a container. The lifting means may comprise one or more rams such as hydraulic or pneumatic rams.

There is an advantage in maximising the distance between the vertical members as this facilitates loading and unloading of shipping containers from the back of trucks. To facilitate this, the attachment means may be moveable between an extended and retracted position. The attachment means may comprise an insertable pin which may be attached to a support member, and the support member may be moveably mounted to a bracket to allow it to move or rotate between the extended and retracted positions.

The bracket may be moveable between an extended and retracted position relative to the vertical member. The bracket may be moveable by one or more hydraulic or pneumatic rams. The bracket may form part of a side shift mechanism.

To make the straddle crane according to the invention compact, each vertical member may be collapsible as well as each horizontal or connecting member. Thus, the vertical members and the horizontal or connecting members may be telescopic.

In another form the invention resides in a straddle carrier for lifting and transporting a shipping container, the straddle carrier comprising separate front and rear towers, each tower being an inverted U-shaped configuration having a pair of vertical members, each vertical member comprising a fixed lower part and an upper part which is extendible and retractable relative to the lower part, an upper connecting member which is attached to the upper part and which is extendible over the top of said shipping container, a ground wheel assembly supporting each said vertical member, such that each tower has two ground wheel assemblies, rigid attachment means on the upper part of each vertical member to attach each tower to a side of the container, the attachment means comprising a projection which pivotally engages with the side of the container, to allow the ground wheel assembly to track the ground surface.

BRIEF DESCRIPTION OF THE DRAWINGS

Embodiments of the invention will be described with reference to the following drawings in which.

BEST MODE

Figure 1:
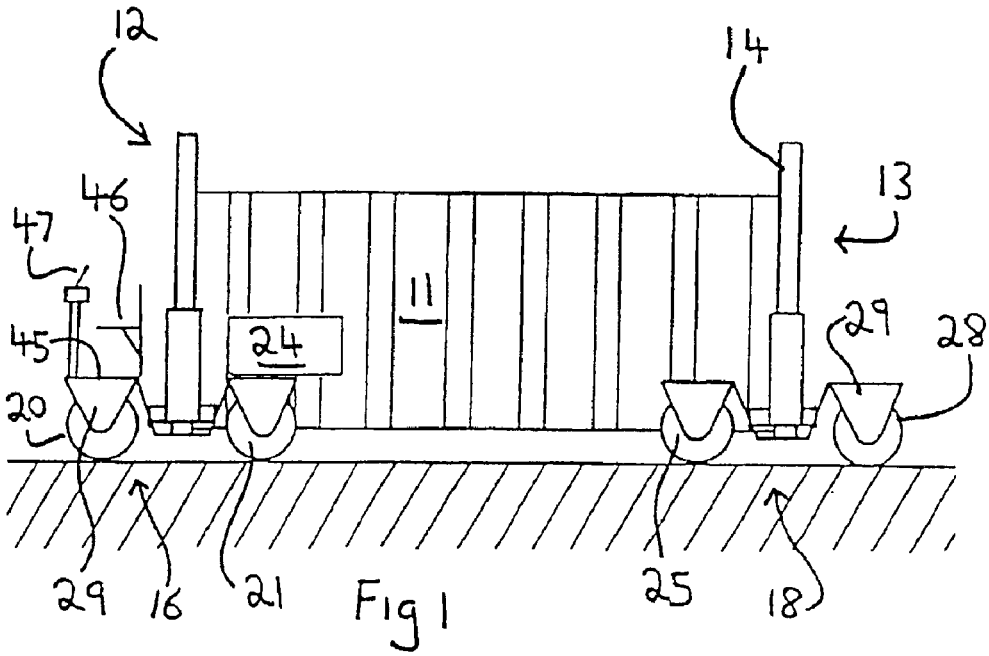
FIG. 1 is a side view of a straddle carrier attached to a container and in the lowered transport position.
Figure 2:
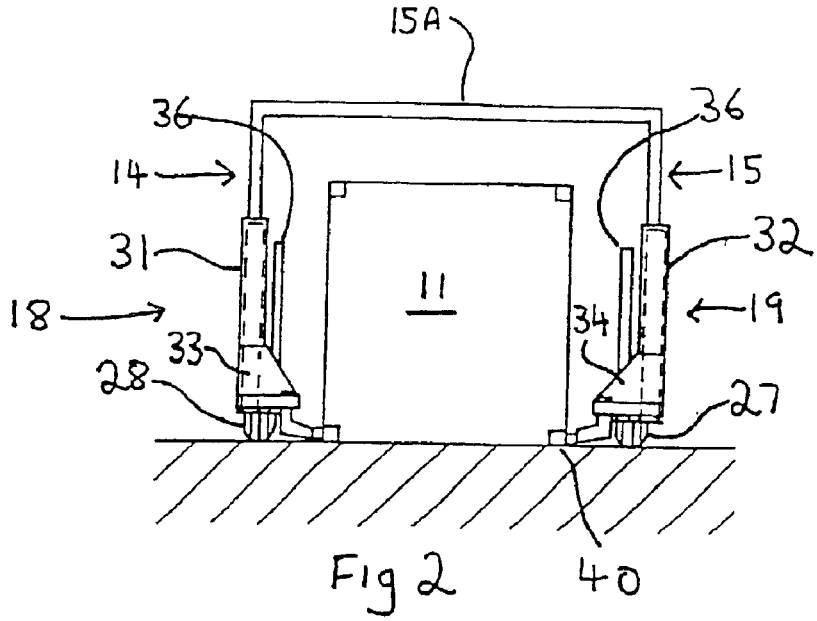
FIG. 2 is an end view of the straddle carrier of FIG. 1.
Figure 3:
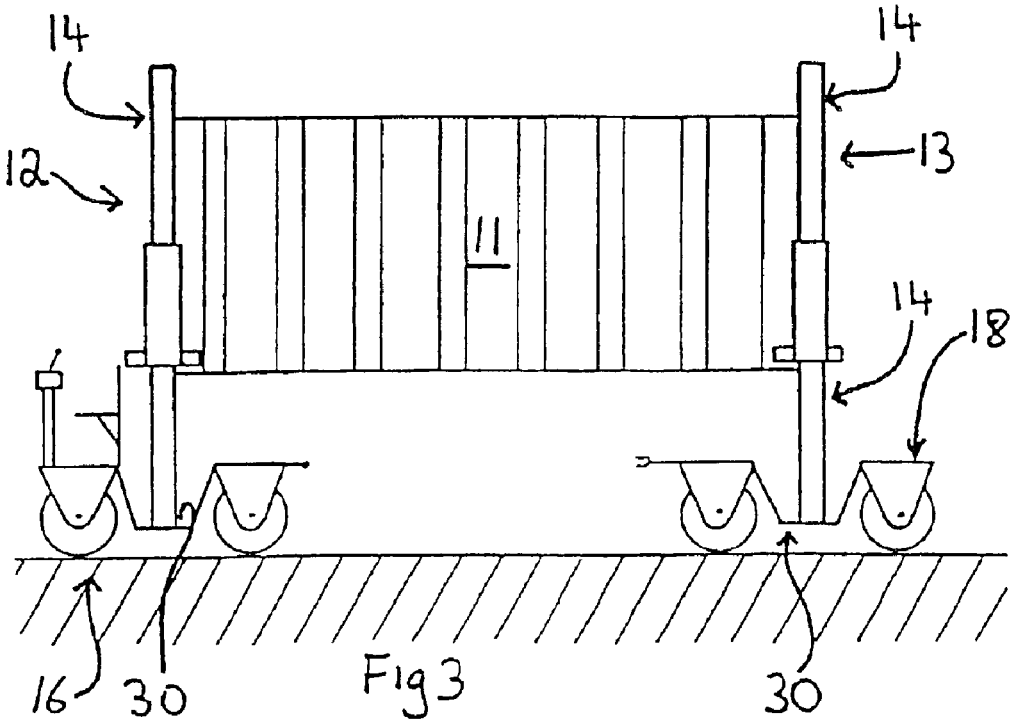
FIG. 3 is a side view of the straddle carrier of FIG. 1 with the container in the elevated position.
Figure 4:
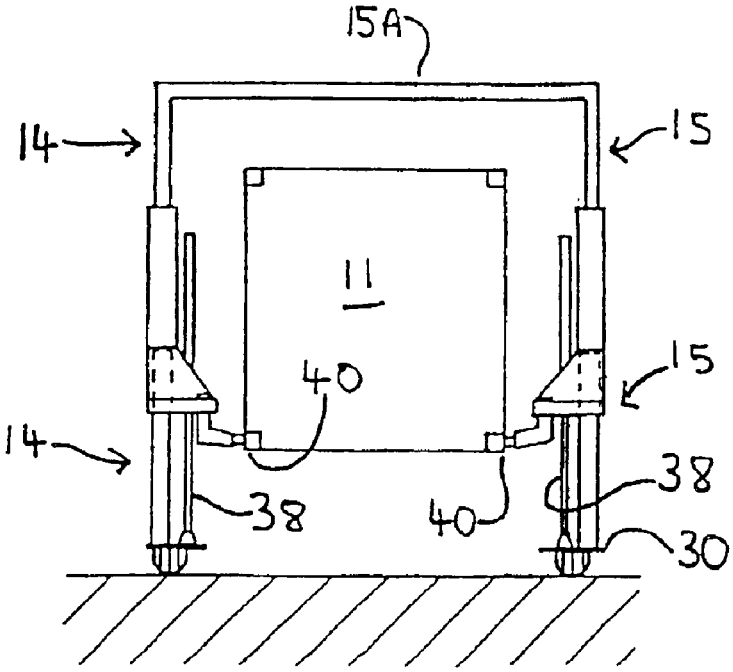
FIG. 4 is an end view of the straddle carrier of FIG. 3.

Referring to the drawings and initially to FIGS. 1–4, there is shown a staddle carrier for lifting and transporting shipping containers 11. The straddle carrier has a front tower 12 and a rear tower 13. Each tower 12, 13 is of a generally inverted U-shaped configuration (see FIGS. 2 and 4). The generally inverted U-shape configuration consists of a pair of vertical members 14, 15 interconnected by an upper horizontal member 15A. Although FIGS. 2 and 4 illustrate rear tower 13, front tower 12 is similarly designed.

Each tower 12, 13 is free-standing, and this is achieved by a ground wheel assembly at the lower end of each vertical member. FIG. 2 illustrates the pair of ground wheel assemblies 18, 19 on rear tower 13 while FIGS. 1 and 3 illustrate only one of the front ground wheel assemblies 16.

Figure 6:
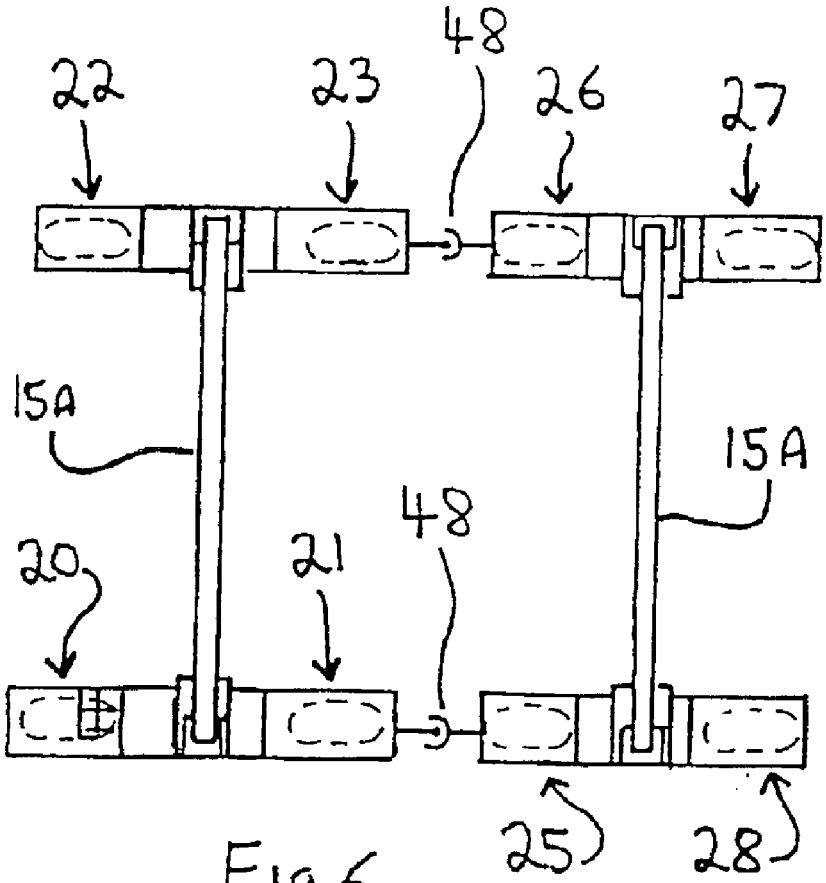
FIG. 6 is a top view of a straddle carrier straddling a container.
Figure 7:
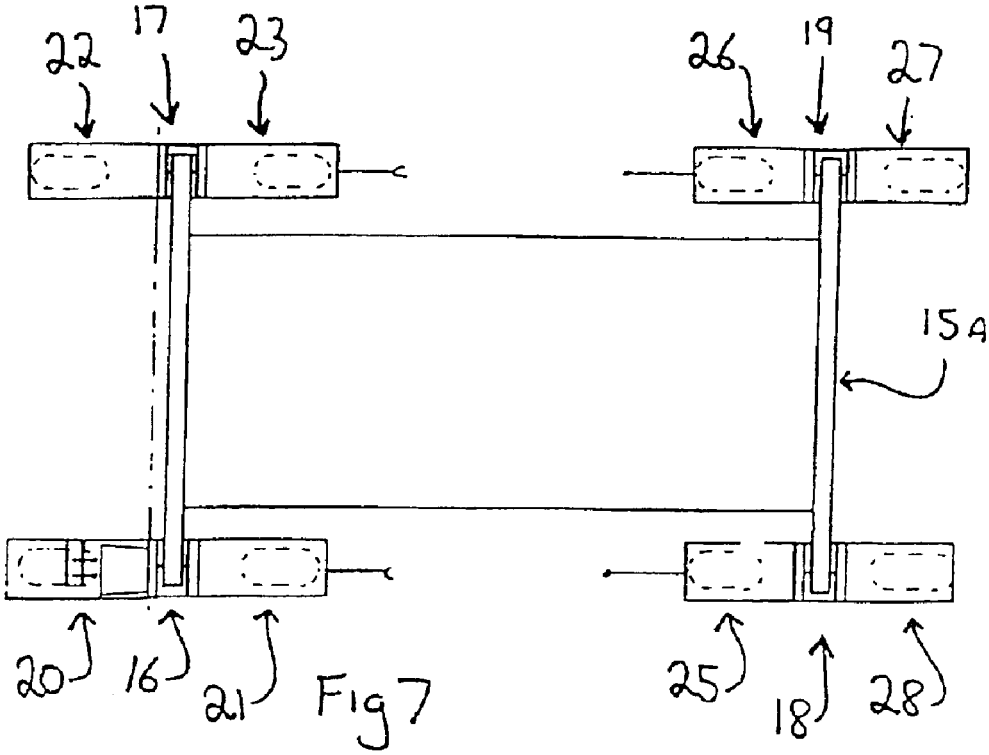
FIG. 7 is a top view of a straddle carrier straddling a container.

Each ground wheel assembly is itself formed from a leading wheel and trailing wheel which are in longitudinal alignment. FIGS. 6 and 7 which are plan views of the staddle carrier show the wheel assemblies more clearly. Front wheel assemblies 16, 17 each have a front leading wheel 20, 22 and a rear trailing wheel 21, 23. Leading wheels 20, 22 are driven wheels and are also steering wheels while trailing wheels 21, 23 are swivel wheels. With the rear wheel assemblies 18, 19, each assembly has a leading swivel wheel 25, 26 and a trailing fixed wheel 27, 28.

Each of the wheels is mounted to a shaft which is journalled into a wheel support plate 29 (see FIG. 1).

Each of the wheel assemblies has a chassis or base plate 30 (see FIG. 3) on which is supported the vertical members 14, 15.

A sleeve member 31, 32 is slidably attached to each vertical member 14, 15 and can slide between a lower retracted position as illustrated in FIG. 2 and an upper extended position as illustrated in FIG. 4.

Figure 8:
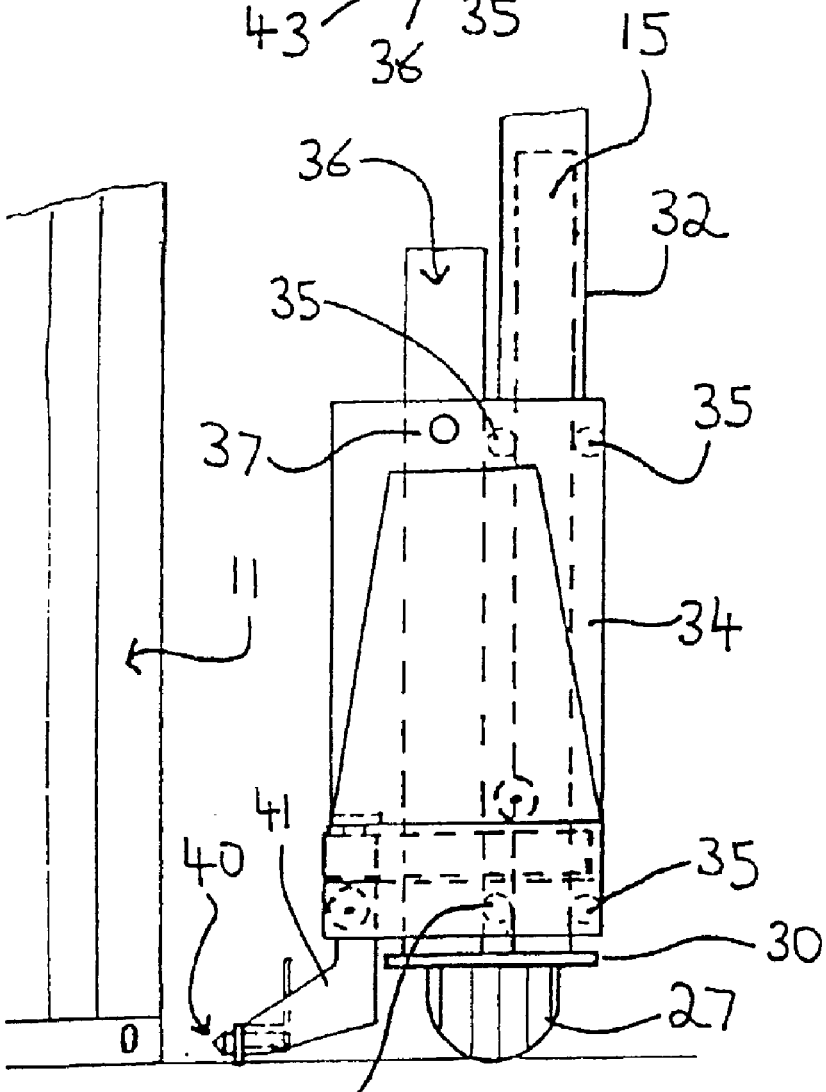
FIG. 8 is an end elevation view of a ground wheel assembly.
Figure 10:
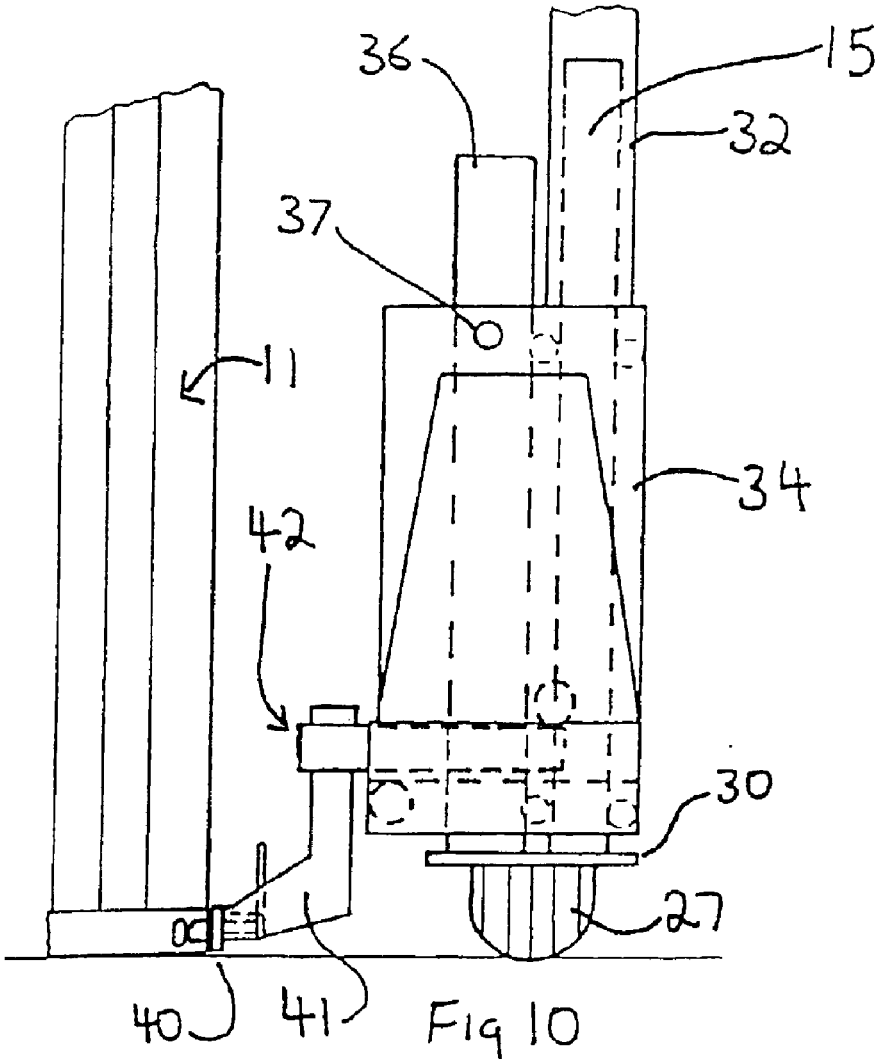
FIG. 10 is an end elevation view of the wheel assembly of FIG. 8 in the extended position.

A lower lifting bracket 33, 34 is attached to or forms part of the sleeve members 31, 32 and this is more clearly illustrated with reference to FIGS. 8 and 10.

Sleeve member 32 slides over vertical member 15, and rollers 35 are located within sleeve 32 to provide a smooth shifting movement of sleeve member 32 along its associated vertical member 15.

30 Sleeve member 32 is moved between its extended position illustrated in FIG. 4 and its retracted position illustrated in FIG. 2 by a lifting means in the form a hydraulic ram 36. Ram 36 has a ram cylinder attached to lifting bracket 34 through a lift eye 37 (see 35 FIGS. 8 and 10), and has a ram piston 38 attached to base plate 30.

To attach each tower to shipping container 11, each tower is provided with two attachment means in the form of locking pins 40 and which are illustrated in FIGS. 2, 4, 8–11. Locking pins 40 can be of a conventional type and are inserted into a corner casting on a shipping container. Of course, if the shipping container does not have a corner casting, the type of locking pin or attachment means may vary to suit. Locking pin 40 is attached to a steel angled support member 41. Support member 41 is mounted for rotation about a vertical axis to a bracket 42. In this manner, support member 41 and thus pin 40 can twist or rotate between an extended position shown in FIGS. 8 and 10 and a retracted position (not shown) where support member 41 is turned 901 either way. The ability to move pins 40 away from shipping container 11 maximises the distance between the vertical members 14, 15 thereby facilitating loading and unloading of containers.

Figure 9:
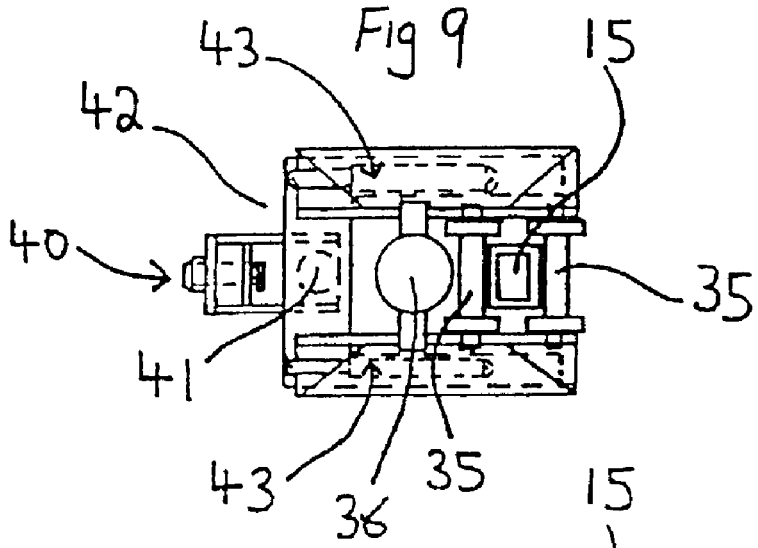
FIG. 9 is a plan view of the assembly of FIG. 8.
Figure 11:
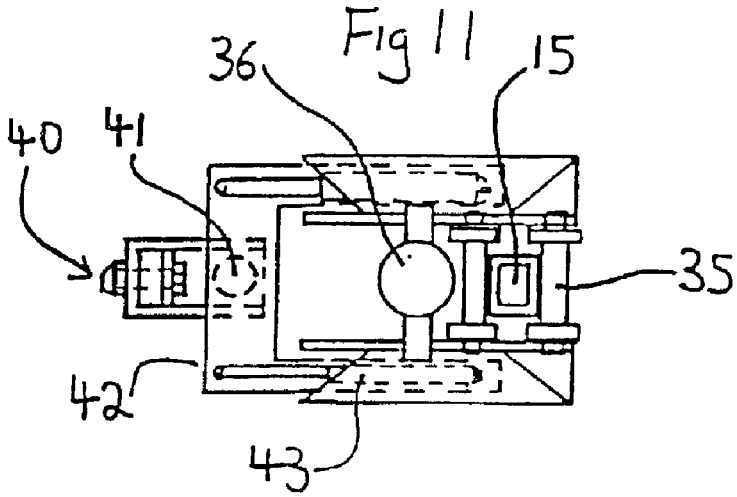
FIG. 11 is a plan view of the assembly of FIG. 10.

Bracket 42 is itself mounted for movement between an extended position as shown in FIG. 11 and a retracted position as shown in FIG. 9. Rams 43 are used to extend or retract bracket 41. Extension of retraction of bracket 41 causes further extension or retraction of pin 40. Thus, when bracket 41 is retracted and support member 41 is rotated to a free position, there is sufficient room between container 11 and the tower to facilitate unloading and loading of the container. By having bracket 42 able to extend and retract, the arrangement provides a side shift mechanism to container 11.

Figure 25:
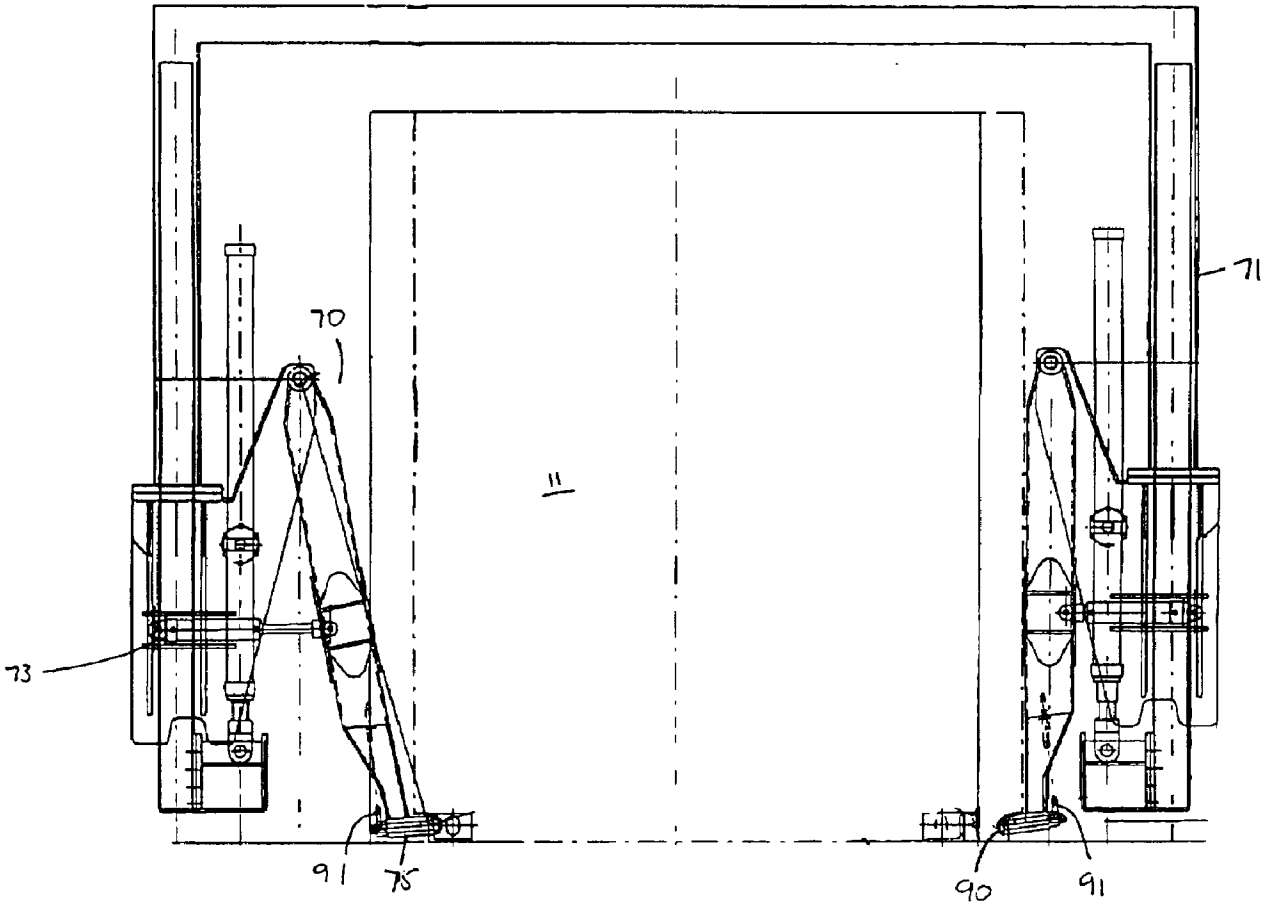
FIG. 25 shows a detailed view of a carrier according to the present invention in particular the sideshift capability.

The side shift mechanism shown most effectively in FIG. 25 helps the operator to position the straddle carrier over the container and to fasten the twist locks. If the straddle is not in line with the container, an operator can side shift the twist lock arm towards the container and thus position the twist lock into the corner casting. The second reason for having the side shift mechanism is to enable the operator to correct the position of the container and to bring it in line with the vehicle that awaits the loading. Thus, the side shift mechanism makes loading containers onto vehicles much faster and efficient and avoids the vehicle driver having to correct his vehicle into the right position. That is, the side shift mechanism will do the corrections instead. The stroke of bracket 42 is suitably about 200 mm.

Figure 14:
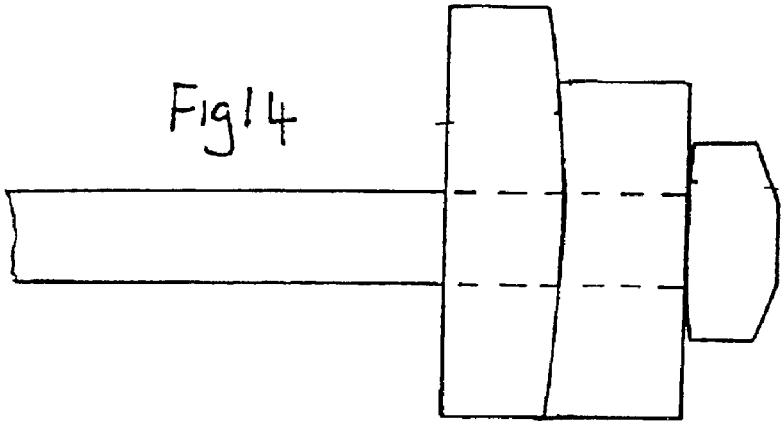
FIG. 14 illustrates a further attachment embodiment.
Figure 13:
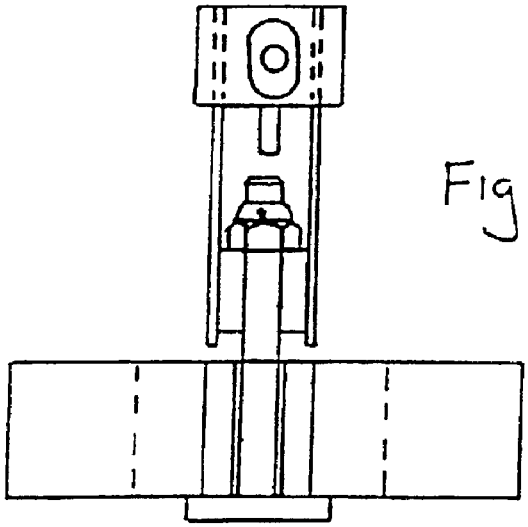
FIG. 13 illustrates the support member in an extended position.
Figure 12:
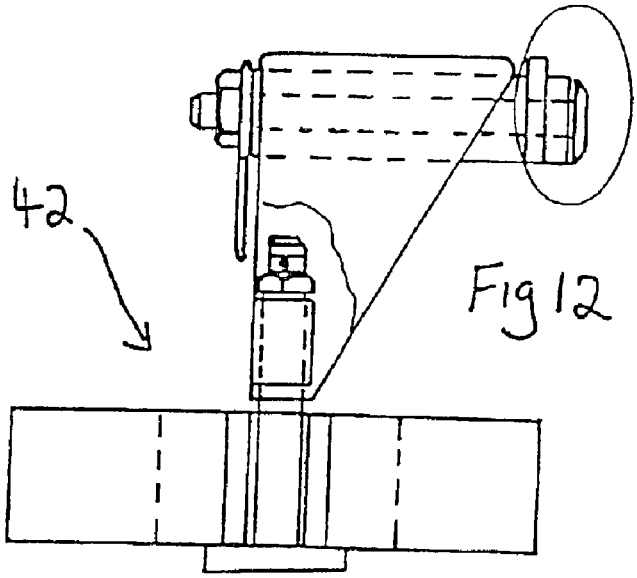
FIG. 12 is a close-up view showing the support member in a retracted position.

To avoid extreme forces on the twist lock arm should the container be out of line widthwise, the face plate that rests against the corner casting of the container, and the twist lock pin that locks the twist lock into the corner casting, both have a machined radius incorporated. This is illustrated in FIGS. 12 and 14. If the container is not level, the radius prevents unacceptable forces from being applied to the twist lock arm, the twist lock and the corner casting.

Figure 20:
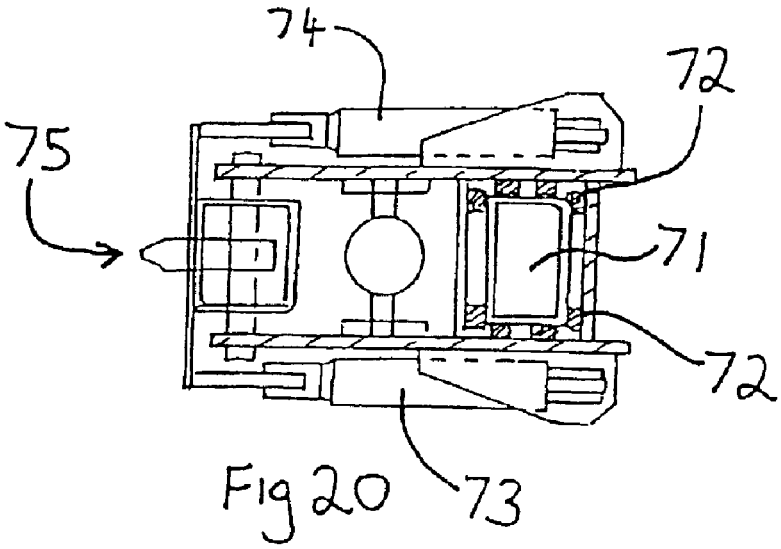
FIGS. 20 and 21 show an alternative arm construction.
Figure 21:
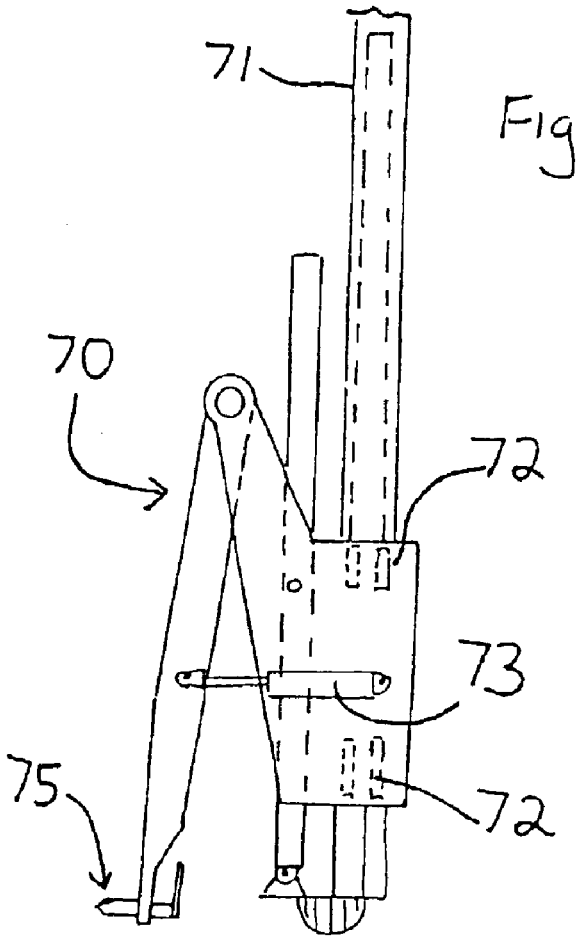
Figure 22:
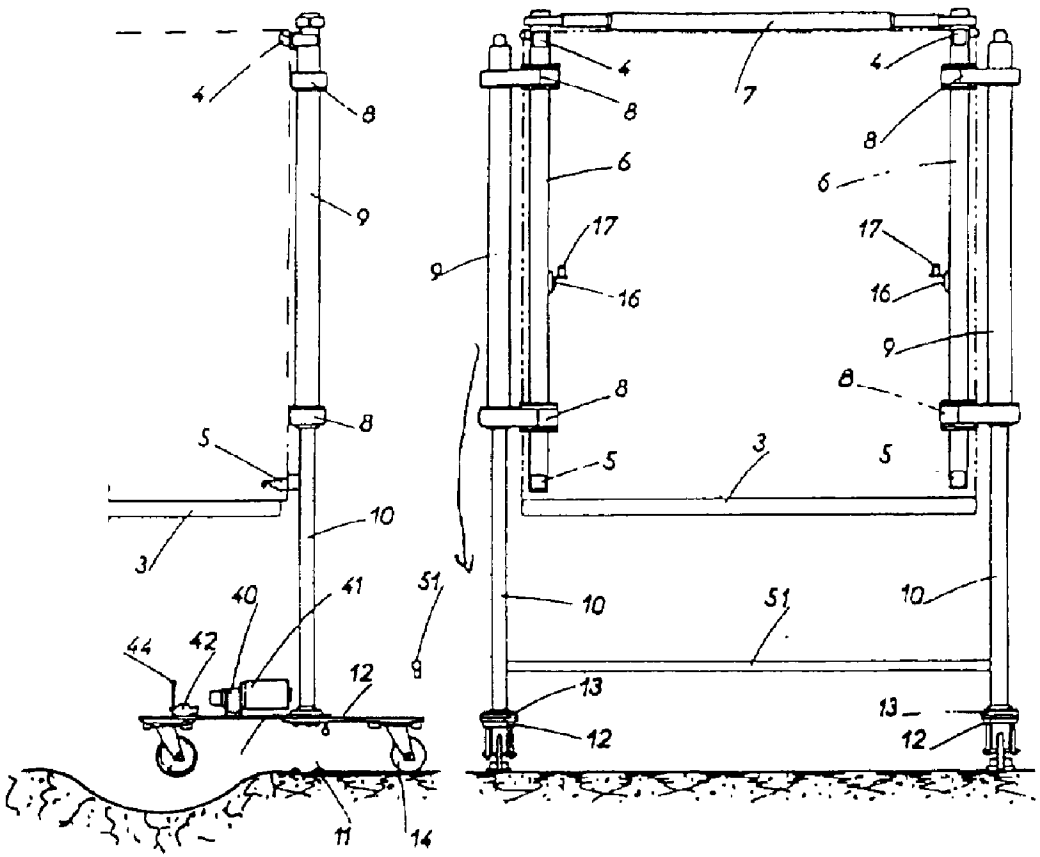
FIGURE 22 PRIOR ART
FIG. 22 shows a prior art carrier and the problem of the wheels not being able to maintain contact with the ground when travelling over rough or uneven ground.
Figure 23:
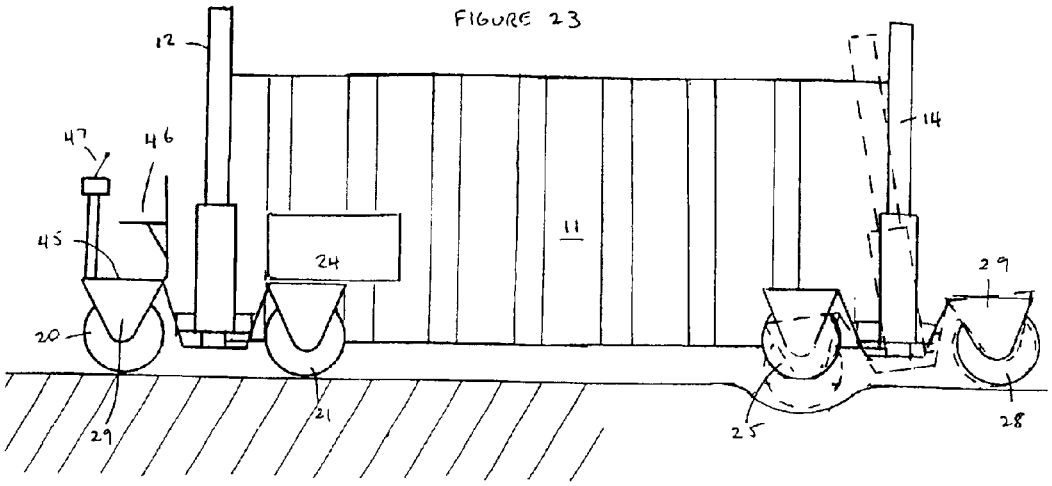
FIG. 23 shows the aspect of the present invention as shown in FIG. 1 an uneven ground situation.
Figure 24:
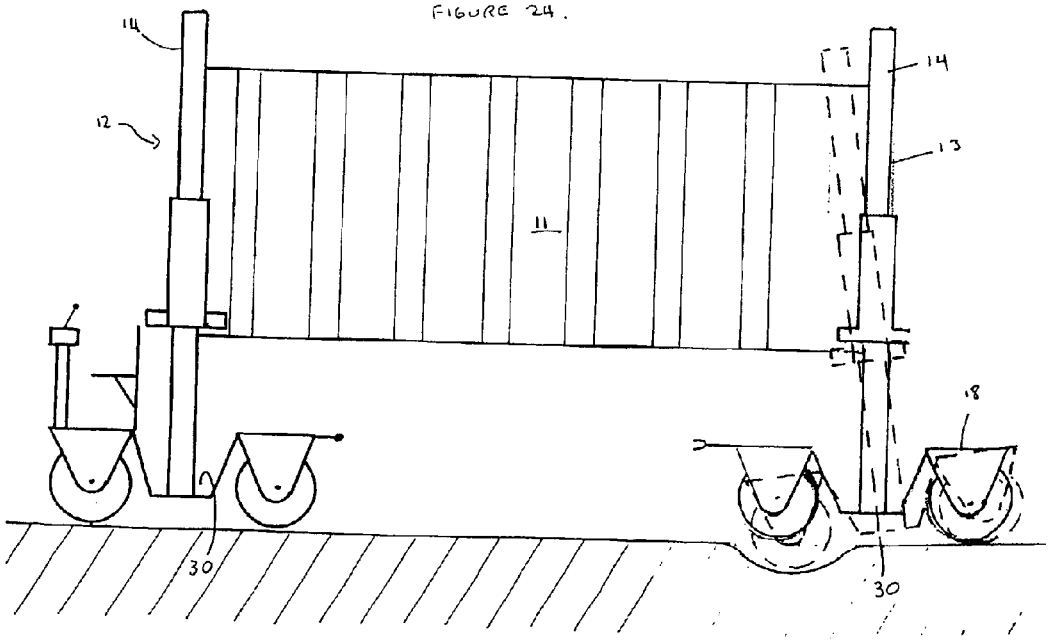
FIG. 24 shows the aspect of the present invention as shown in FIG. 3 an uneven ground situation.

FIGS. 20 and 21 illustrate an alternative construction where a pendulum arm 70 is slidably attached to a vertical member 71 through nylon gliders 72. Pendulum arm 70 can move to and away from a container by two rams 73, 74. The free end of arm 70 is fitted with a twistlock 75. This alternative construction reduces forces on the apparatus.

Figure 5:
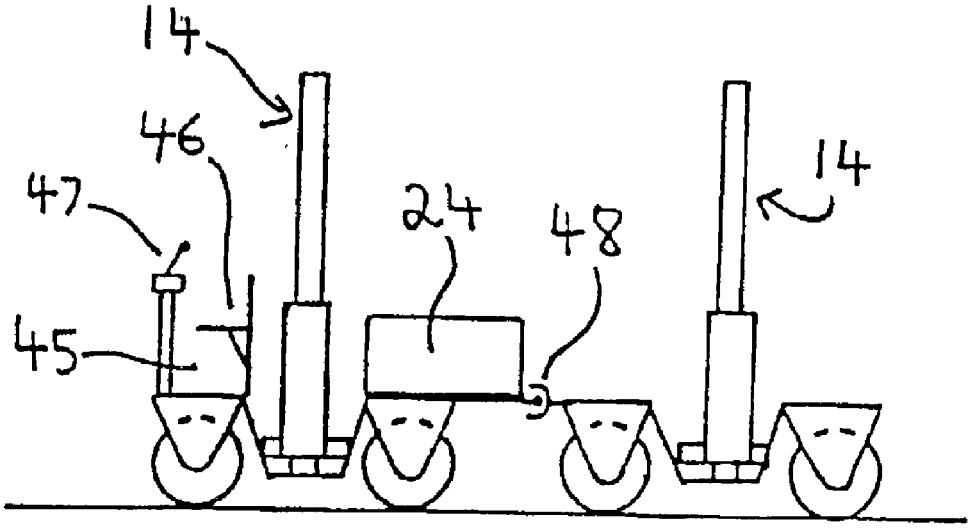
FIG. 5 is a side view of the straddle carrier of FIG. 1 when not in use.

In use, the straddle carrier initially has the two towers connected together as illustrated in FIG. 5. The straddle carrier is self-propelled and has an engine 24 to power the drive wheels (which can be hydraulically driven and steered), and which also provides hydraulic fluid to the various rams. The forward tower has a platform 45 provided with an operator's seat 46, and steering and other controls 47. When in the coupled arrangement as illustrated in FIG. 5, the straddle carrier can be driven around. The coup ling 48 can be of any convenient type but should be one which can be fairly easily decoupled.

To lift a container, the coupled straddle carrier is driven over the container which is initially on the ground. The rear tower 13 is positioned at the rear end of the container and when in position, the pins are connected with the container corner casting. Each pin can be moved vertically by raising or lowering the respective sleeve members 31, 32 and can be moved sidewardly by the side shift mechanism as illustrated in FIGS. 8–11 and 25. When the rear tower is locked in position, it is decoupled from the front tower and the front tower is driven forwardly to the front of the container where again it is locked to each corner of the container. The container can then be lifted approximately 300 or 400 mm above the ground level as illustrated in FIG. 1 and can then be driven to a desired area at about 5 km p/hour. One of the advantages of the staddle carrier is that the container is only slightly lifted above the ground which provides the entire arrangement with a low centre of gravity. Also, the towers are coupled to the container and the container itself can be seen as forming part of the horizontal chassis.

When loading a shipping container onto a truck, the straddle carrier is driven into position with the container in the lower position as illustrated in FIG. 1. The staddle carrier is then halted and container 11 is lifted to an upper position as illustrated in FIG. 3, the position being high enough to allow a truck to pass underneath the container. The container can then be lowered onto the back of a truck and the side shift mechanism as illustrated in FIGS. 8–11 and 25 can be used to ensure that the corner castings align with the locking pins on the back of the truck.

The carrier allows the towers to pivot with respect to the container 11. This results in the container 11 remaining substantially level even when travelling over rough ground. The attachment pins of each tower engage the container corner castings and when a section of uneven ground is reached, the pins can rotate within the corner castings to allow the container to remain level. Due to the wheels being able to maintain contact with the ground, the torsional forces are reduced and this leads to a reduction in stress cracking and the concentration of loading forces, and a corresponding increase in the versatility and safety of the carrier.

Each pin has a head 90 with a cam or twist lock 75 to engageable with the ISO corner castings. Each pin is rotatable between a locked position where the cam lock engages and locks the pin into the corner casting and an unlocked position where the pin is not locked into the corner casting. While the pin is in the unlocked position, it may still be located in the corner casting but not locked into it. The pin may be maintained in the corner casting by the operation of the side shift mechanism. Each pin also comprises a twist arm 91 to allow the pin to be moved between the locked and unlocked position.

The functionality of the present invention is provided through the use of attachment pins 40 on each tower being attached to the side of the container 11 as opposed to the front or rear ends of the container 11, in conjunction with the front 12 and rear 13 towers not being attached to each other rigidly. The carrier can pivot with respect to the container 11 as the container 11 then remains in a relatively level orientation at all times, particularly when being lifted onto and from the back of a truck or while the container 11 is being moved.

To position the straddle over a container, it is important to have as much space as possible between the container and the straddle. To make it easy for the operator to manoeuvre, the space between the inside of the staddle and the container should be about 600 mm. The straddle carrier according to the invention makes this possible by having the locking pin 40 collapsible allowing for maximum clearance.

FIG. 15-19 illustrate further embodiments of the straddle carrier to make it extremely compact and thus able to be driven into a container such that the straddle carrier can be shipped with the container.

Figures 15, 16, 17:
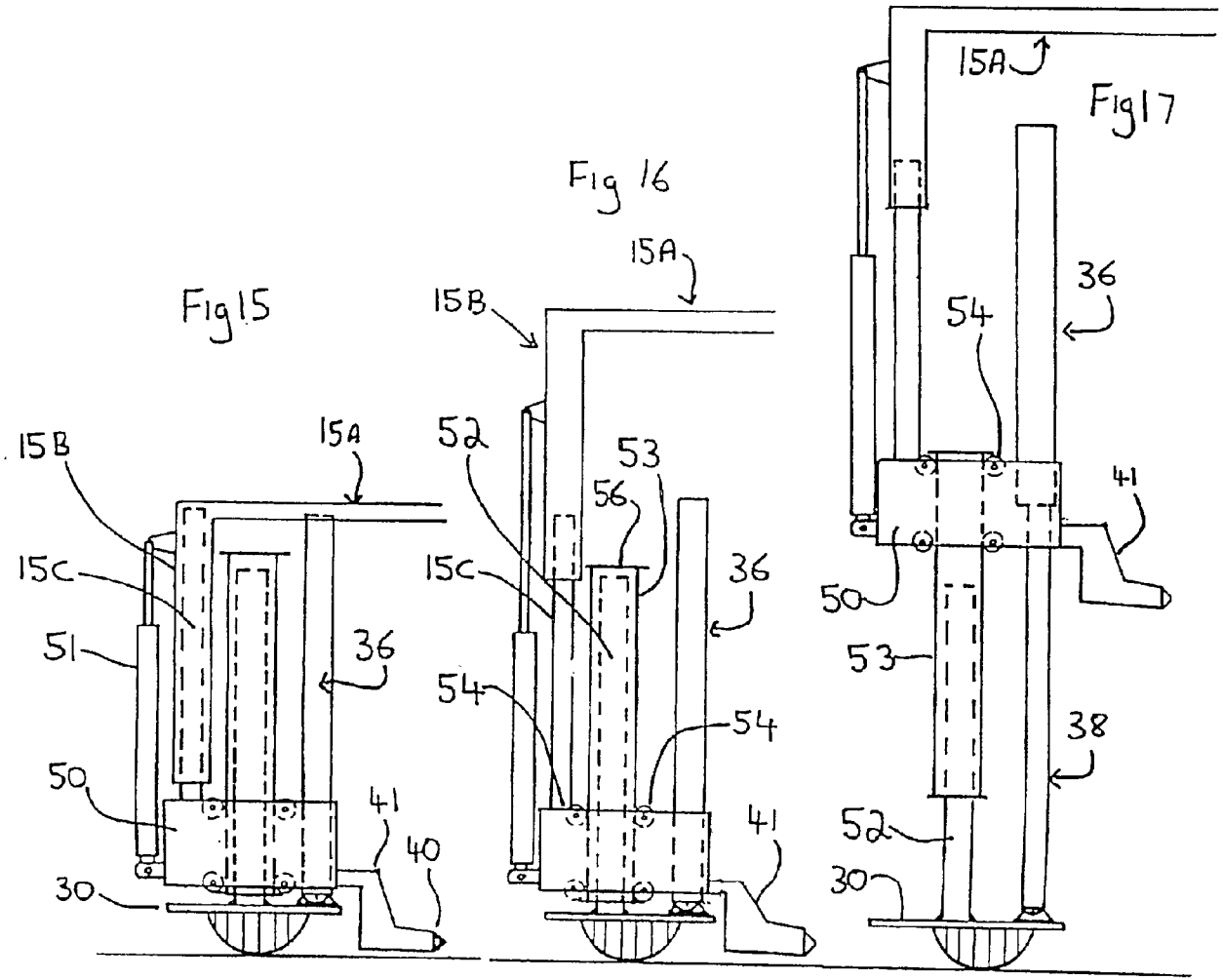
FIG. 15 shows a ground wheel assembly in a totally collapsed state.
FIG. 16 shows the ground wheel assembly of FIG. 1.5 in a partially extended state.
FIG. 17 shows the ground wheel assembly of FIG. 1.5 is a fully extended state.

To provide a low height profile to the straddle carrier, the vertical members 14, 15 may themselves be telescopic. In FIG. 15, the straddle carrier is collapsed such that the distance between horizontal member 15A and the ground is about 1.9 m, while in the fully extended position shown in FIG. 17, the distance between horizontal member 15A and the ground is 4.6 m. In FIG. 15, vertical member 15 is provided in two telescopic sections being outer telescopic section 15B and inner telescopic section 15C. The inner telescopic section 15C is attached to a lifting bracket 50. Vertical member 15 can be expanded and contracted through ram 51 and FIGS. 15 and 16 show how expansion of ram 51 causes vertical member 15 to extend upwardly. When in the extended position shown in FIG. 16, ram 36 is operated which in turn lifts lifting bracket 50. To stabilise the system, a guide post 52 is attached to base plate 30 and extends to a position lower than the height of ram 36. A sleeve 53 is positioned about guide post 52 and lifting bracket 50 is guided along sleeve 53 through rollers 54.

It can be seen that upon operation of ram 36, lifting bracket 50 is raised upwardly and rolls along the outside of sleeve 53. The top of sleeve 53 has an abutment plate 56, and when rollers 54 strike abutment plate 56, further expansion of ram 36 will now cause sleeve 53 to move upwardly along guide post 52.

The overall effect is that the height of horizontal member 15A can be from 4.6 m in the fully extended position shown in FIG. 17 down to 1.9 m in the fully retracted position shown in FIG. 15.

Figure 19:
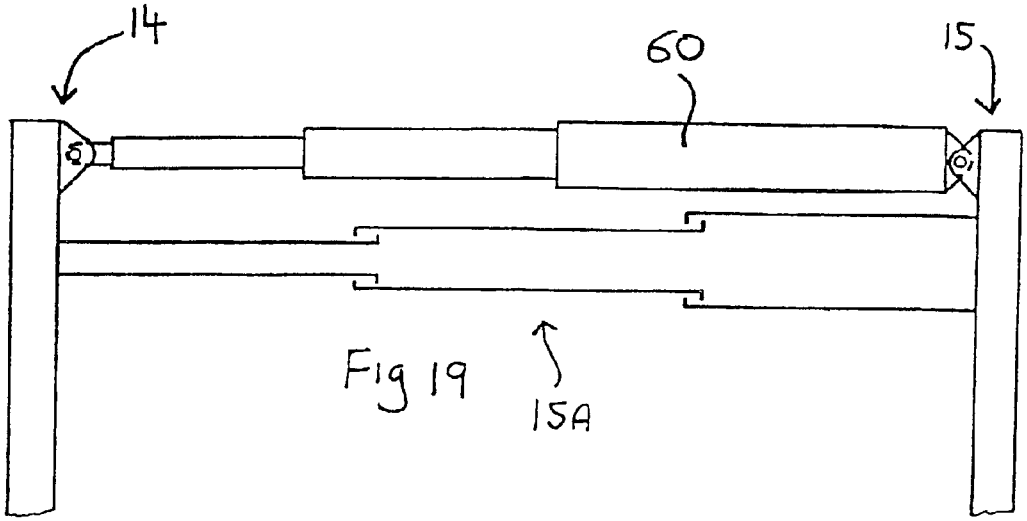
FIG. 19 shows the horizontal member of FIG. 18 in an extended state.
Figure 18:
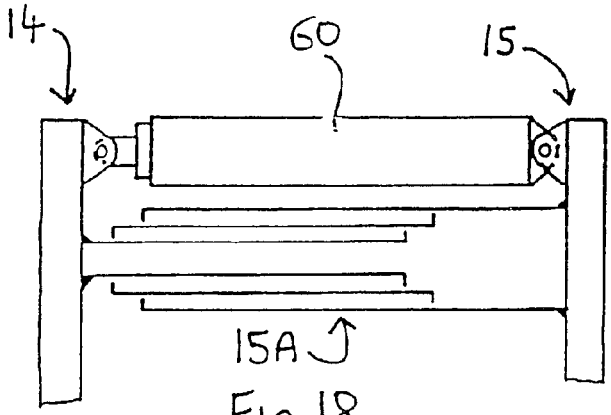
FIG. 18 shows a top horizontal member in a collapsed state.

FIGS. 18 and 19 show how the upper horizontal member 15A is itself telescopic and can move between a retracted position shown in FIG. 18 where vertical members 14, 15 are about 2 m apart to a fully extended position as illustrated in FIG. 19 where vertical members 14, 15 are 4.5 m apart. A three-stage ram 60 is used to move horizontal member. The ram 60 is activated when the towers are slowly being moved on their wheels. The wheels will allow expansion and retraction without undue stresses.

The collapsible straddle carrier as described above is of benefit to organisations wishing to transport the straddle carrier without dismantling it. The collapsed sides of the straddle carrier are such that it fits in an 8 ft. high, 20 ft. long ISO container. The collapsible straddle can be loaded within a container and can unload itself out of the container without the help of lifting equipment. When unloaded, the straddle carrier can then attach itself to the outside of the container and lift it to transport it and also to load it onto the back of a truck.

Some of the advantages of the straddle carrier are that the system is lighter than conventional straddle carriers, the straddle carrier has a very low working height of approximately 3.5 m allowing it to work under awnings or inside buildings. The staddle carrier can handle any length of containers without modification.

It should be appreciated that various other changes and modifications may be made to the embodiment described without departing from the spirit or scope of the invention.

What is claimed is:

1. A straddle carrier for lifting and transporting a shipping container over a ground surface, the straddle carrier comprising:

(a) separate front and rear towers, said front and rear towers detachably connected to one another, each tower having a pair of vertical members, each vertical member comprising a fixed lower part and an upper part which is extendible and retractable relative to the lower part, (b) an upper connecting member which is attached to the upper part and which is extendible above a top of said shipping container, (c) a ground wheel assembly supporting each said vertical member, such that each tower has two ground wheel assemblies, (d) rigid attachment means on the upper part of each vertical member to attach each tower to a side of the container, the attachment means comprising a projection which engages with the side of the container, to allow the tower to pivot relative to the container to allow the ground wheel assembly to track the ground surface.

2. The carrier of claim 1, comprising a drive means on one of the towers to drive the ground wheel assembly.

3. The carrier of claim 2, wherein the drive means drives the ground wheel assembly of only one of the vertical members.

4.The carrier of claim 2, comprising steering means on one of the towers to steer the carrier.

5. The carrier of claim 1, wherein the upper connecting member is length adjustable.

6. The carrier of claim 5, comprising a ram which is attachable to each upper part of a tower, the connecting member there between being extended and retracted upon extension and retraction of the ram.

7. The carrier of claim 1, wherein each vertical member comprises a plurality of separate segment which are telescopically extendible and retractable relative to each other.

8. The carrier of claim 1, wherein the attachment means only attaches to a lower portion of the container.

9. The carrier of claim 1, wherein the front tower and the rear tower are not structurally interconnected.

10. The carrier of claim 9, wherein the vertical members of each tower are interconnected only by the upper connecting member.

11. The carrier of claim 1, wherein the attachment means are movable between an extended position where the attachment means is positioned for attachment to a container, and a retracted position where the attachment means is a distance from the container.

12. The carrier of claim 11, wherein the attachment means extends and retracts along an axis which is at right angles to the vertical member.

13. A straddle carrier for lifting and transporting a shipping container over a ground surface, the straddle carrier comprising:

(a) separate front and rear towers, each tower having a pair of vertical members, each vertical member comprising a fixed lower part and an upper part which is extendible and retractable relative to the lower part, (b) an upper connecting member which is attached to the upper part and which is extendible above a top of said shipping container, (c) a ground wheel assembly supporting each said vertical member, such that each tower has two ground wheel assemblies, and (d) rigid attachment means on the upper part of each vertical member to attach each tower to a side of the container, the attachment means comprising an arm member having a first end and a second end associated with each upper part, a support member having a first end arid a second end, the first end of the arm member associated with the upper part of each vertical member, the second end of the arm member pivotally attached to the first end of the support member, and a projection which engages with the side of the container, to allow the tower to pivot relative to the container to allow the ground wheel assembly to track the ground surface, the projection associated with the second end of the support member, the support member movable between an extended position where the projection is positioned for engaging the container, and a retracted position where the projection is a distance from the container.

14. The carrier of claim 13, wherein the support member is movable between the extended container engaging position and the retracted position which, is free from the container, by a ram.

15. The carrier of claim 1, wherein each vertical member is provided in two telescopic sections being an outer telescopic section and an inner telescopic section, the carrier further comprising a lifting bracket to which the inner telescopic section is attached, the lifting bracket containing the attachment means, a ram operatively connected to the sections to extend and retract the sections, a horizontal base plate, an upright guide post attached to the base plate, a slidable sleeve positioned about the guide post in a telescopic manner and slidable along the guide post, the lifting bracket being slidable along the sleeve, and a ram attached to the base plate and the lifting bracket to slide the lifting bracket along the sleeve.

16. The carrier of claim 1, wherein the vertical members have at least one telescoping section associated with the art and the upper part.

17. The carrier of claim 1, wherein the front and rear towers are detachable connectable relative to one another via a tow and hitch arrangement, directly connecting the towers.

18. The carrier of claim 1, wherein the front and rear towers are detachable connectable relative to one another indirectly via the container when the attachment means engage a container for lifting and transporting.

* * * * *